US005558323A

United States Patent [19]

LoFaso, Sr.

[11] Patent Number: 5,558,323

[45] Date of Patent: Sep. 24, 1996

[54] BASKETBALL PRACTICE DEVICE

[76] Inventor: Samuel J. LoFaso, Sr., 242 Linda Visa Rd., Sewickley, Pa. 15143

[21] Appl. No.: 556,405

[22] Filed: Nov. 13, 1995

[51] Int. Cl.[6] ..... A63B 69/00

[52] U.S. Cl. ..... 237/1.5 A

[58] Field of Search ..... 273/1.5 A, 1.5 R

[56] References Cited

U.S. PATENT DOCUMENTS 5,165,680 11/1992 Cass ..... 273/1.5 A

*Primary Examiner*—Paul E. Shapiro

*Attorney, Agent, or Firm*—Carothers & Carothers

[57] ABSTRACT

A basketball practice device wherein an auxiliary target ring is supported above a standard horizontal basketball hoop or ring in a plane that is disposed at an acute angle from the plane of the supporting ring. An adjustment mechanism as provided for selectively adjusting and maintaining this acute angle between the auxiliary target ring and the standard basketball hoop.

10 Claims, 3 Drawing Sheets

BASKETBALL PRACTICE DEVICE

BACKGROUND OF THE INVENTION

The present Invention relates to a basketball practice device adapted to be mounted independently or on a standard basketball goal or ring.

It is desirable that basketball players develop a high degree of accuracy in throwing the ball from various locations on the basketball floor such that the ball will drop into the basket. This is particularly true with regard to foul shots.

While some players have reasonably good skills in making jump shots and lay-up shots, they can nevertheless have considerable difficulty in making foul shots from the foul line. In shooting such foul shots, it is desirable to learn to make the shots with the proper arc such that the ball tails directly through the basket and does not engage the basket rim. This is generally referred to as a "swish" shot.

The basket hoop or ring is mounted in a horizontal fashion and projects from a backboard. Of course, when the basket so mounted is viewed from the playing floor by the basketball player, one is not able to visualize the true size of the target or hoop and they are not readily able to judge the arc through which the ball must travel to "swish" through the hoop.

In order to enhance the player's view of the target and help them to better judge the required arc of the ball to be thrown, and to further become more proficient in making foul shots by educating ones muscles to continuously react in the same manner each time, an auxiliary practice ring as illustrated in U.S. Pat. No. 2,039,794 was developed wherein an auxiliary ring is supported above a basketball basket supporting ring at an acute angle thereto whereby players can throw a ball through the auxiliary ring and the basket supporting ring. The auxiliary ring, not being in a horizontal plane, provides the player with a true picture as to actually how large the hoop or ring diameter is and additionally provides a large visual target for the basketball player, giving him or her an accurate visual arc through which the basketball must travel in order to properly drop through both rings.

The problem with such prior art devices is that while they certainly assist in training the "muscle memory" of the shooter, the practice device is not adapted to accommodate the different proficiencies for the different skill levels of different basketball players. Accordingly, the players are not encouraged to acquire their greatest degree of proficiency in shooting foul shots.

It is a principal object of the present invention to eliminate this deficiency and provide a basketball practice device which will match the proficiency of all basketball players, from the beginner to the professional, and encourage them to attain ever higher degrees of proficiency.

SUMMARY OF THE INVENTION

The basketball practice device of the present invention includes an auxiliary ring and means for supporting this auxiliary ring in general above a basketball supporting ring or hoop. This auxiliary ring is supported in a plane disposed at an acute angle from the horizontal plane of the supporting ring. Additionally, and most importantly, an adjustment mechanism is provided for selectively adjusting and maintaining this acute angle between the auxiliary ring and the supporting ring. In this manner, the upper target auxiliary ring can be hinged to an ever lower or smaller acute angle relative to the horizontal standard or supporting hoop or ring as the proficiency of the shooter increases. Eventually the shooter no longer requires the visual target of the auxiliary ring and can visualize the same without its presence on top of the basketball hoop. At this stage his or her proficiency, through "muscle memory", has been realized to the full capabilities of the individual shooter.

The supporting hoop or ring which supports the target or auxiliary ring, may in fact be the conventional basketball hoop itself which is mounted to a backboard, or it may be an independent supporting ring that is generally similar in size to the standard basketball ring and is adapted to be placed thereon for support. In this latter instance, a releasable locking mechanism is utilized to secure the supporting ring to the standard basketball ring. When mounted on a conventional standard ring, a releasable attaching mechanism is provided for secuting the supporting ring to the standard ring. When provided independent of the standard ring, the supporting ring itself may be provided with a conventional basketball hoop bracket for mounting it to a backboard surface.

When mounted to a standard basketball ring, the supporting ring, together with its attached target auxiliary ring, is rotatable relative to the standard ring about a vertical axis or the vertical axis of the standard basketball ring or hoop.

The releasable mechanism for holding the supporting ring to the standard ring, preferably includes a plurality of circumferentially spaced hooks that depend downwardly from the supporting ring and engage the standard ring in clamping engagement. One of the hooks is adjustable so that it may be loosened and thereby permits separation of the two rings, or relative rotation of the two rings.

In order to permit adjustment of the acute angle between the target auxiliary ring and the underlying supporting or standard ring, a hinge secures the auxiliary ring and supporting ting together for providing selective adjustment of this acute angle on a horizontal axis of the hinge. Also, at least one support arm is disposed between the auxiliary target ring and the supporting ring for maintaining the selected acute angle between the rings. A clamp is provided and adapted the adjustably clamping the one or more arms at selectable positions relative to one of the auxiliary or supporting ring for maintaining the rings at the acute angle selected.

For example, the target auxiliary ring might be positioned at an acute angle of 52° to 54° relative to the horizontal plane of the supporting ring for a beginner. As efficiency of a shooter increases, this angle is gradually decreased until the auxiliary or target ring is left in a flat horizontal position on top of the supporting ring. As this acute angle decreases, the clamp mechanism may be adjusted so that the support arms are unclamped and clamped again after the acute angle between the rings has been adjusted to a new setting.

Generally two such support arms are preferably provided with respective clamps and these two support arms are spaced from each other and the hinge. The hinge would of course be positioned at the forward end of the hoop or rings, facing the shooter, so that the target auxiliary ring laces the shooter.

Stops may be provided on the support arms to prevent these arms from accidentally separating from their respective clamps. Also, generally the auxiliary ring is substantially the same size as the standard basketball ring so that the shooter perceives an accurate size of the actual standard hoop or ring through which the ball must pass in its arc of travel.

BRIEF DESCRIPTION OF THE DRAWINGS

Other objects and advantages will become apparent in the following description and claims. The accompanying drawings show, for the purpose of exemplification and without limiting the invention, certain practical embodiments of the present invention wherein:

DETAILED DESCRIPTION OF THE DRAWINGS

Figure 1:
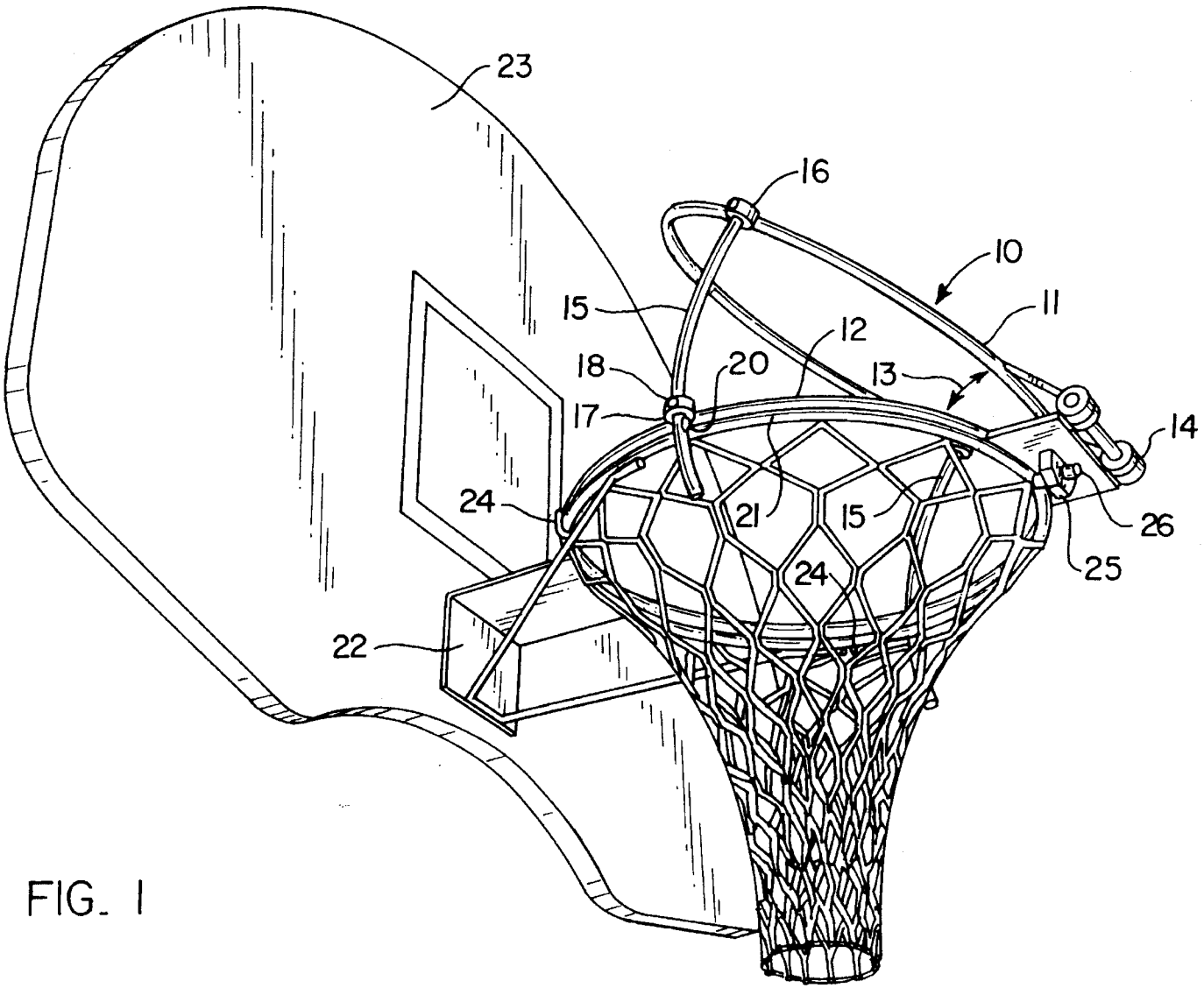
FIG. 1 is a perspective view of the basketball practice device of the present invention as seen from below and to the left.
Figure 2:
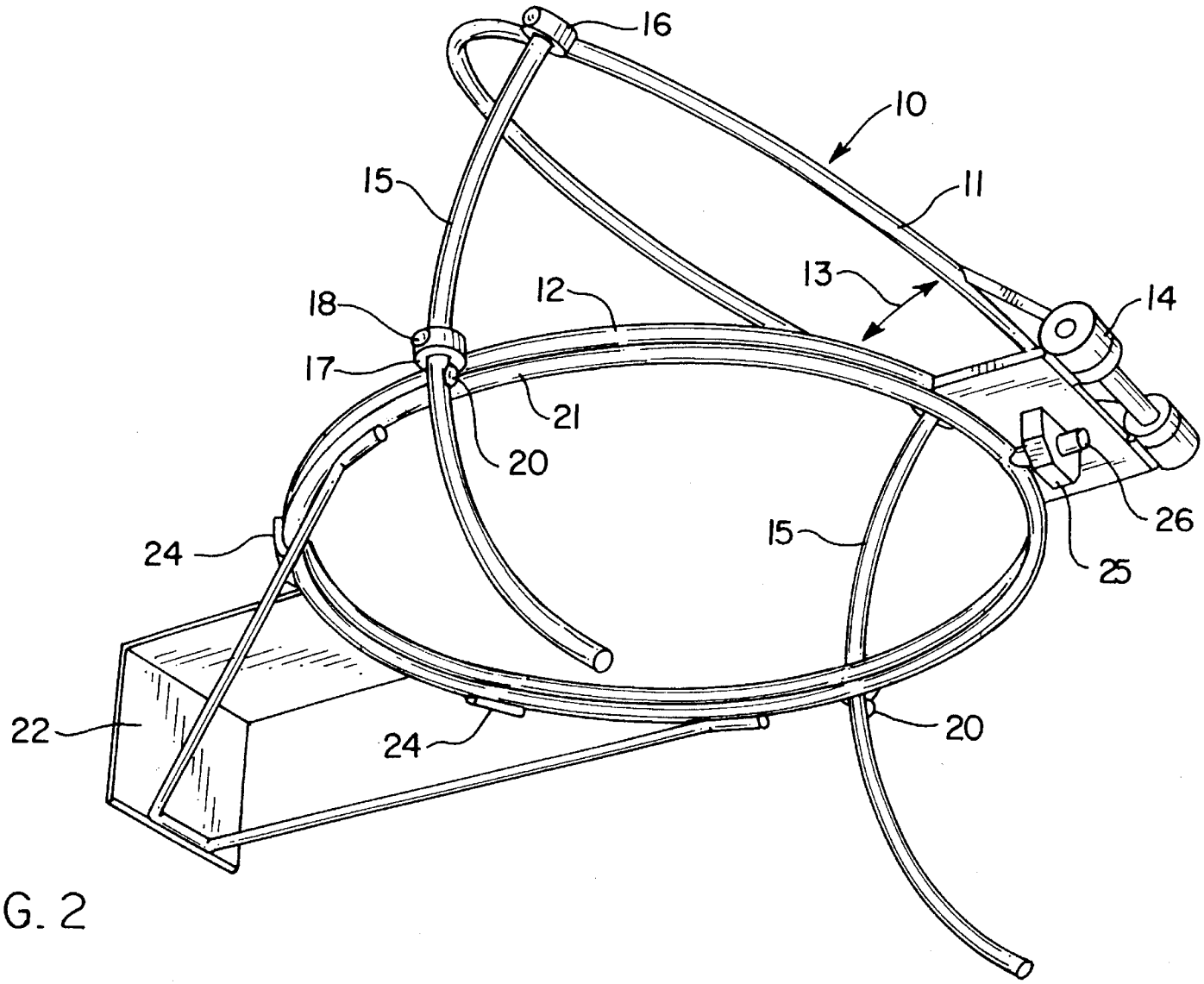
FIG. 2 is a perspective view of the basketball device of the present invention as shown in FIG. 1 with the backboard and basketball net removed for greater clarity.
Figure 3:
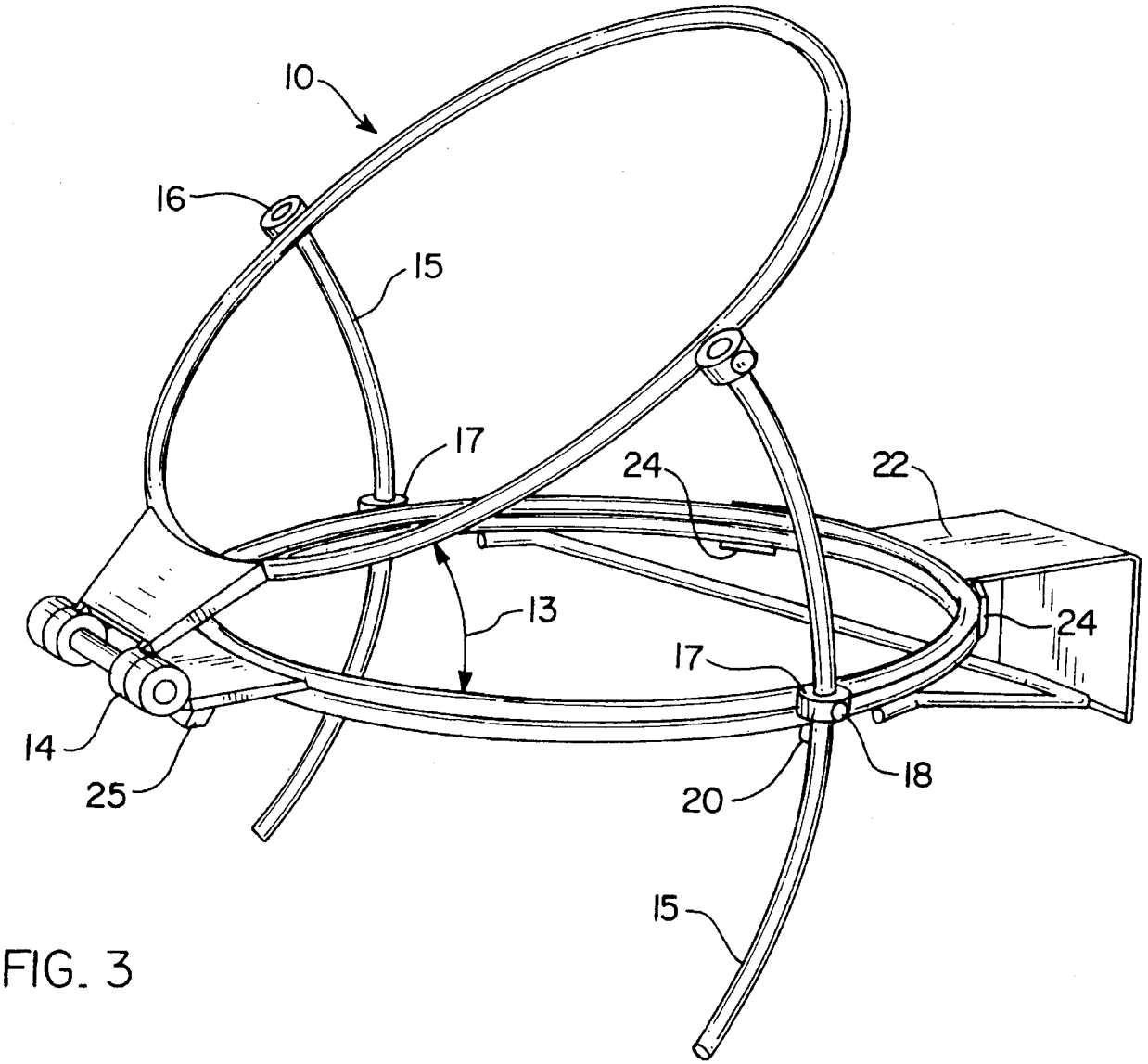
FIG. 3 is a perspective view of the basketball practice device shown in FIG. 1 as seen from above and to the fight and with the basketball backboard and net removed tier clarity.

Referting to the drawings, the basketball practice device 10 of the present invention includes a target auxiliary ring 11 which is supported from and generally above a basketball supporting ring 12. Target auxiliary ring 11 is supported in a plane which is disposed at an acute angle 13 from the horizontal plane eft supporting ring 12. Acute angle 13 is generally selected to be approximately 52° to 53° in its greatest or most extended position for the beginning or non-proficient shooter.

An adjustment mechanism is provided to adjust acute angle 13 and includes forward hinge 14 which secures auxiliary ring 11 and supporting ring 12 together on a horizontal hinged axis for selected adjustment of acute angle 13.

Arcuate support arms 15 are disposed between auxiliary ring 11 and supporting ting 12 for maintaining the selected angle 13. The upper ends of arcuate support arms 15 are secured either permanently by welding to upper auxiliary ring 11 or by conventional clamps 16 as illustrated in the figures.

On opposite sides of supporting ring 12 lower adjustable clamps 17 are provided near the bottom end of arcuate supporting arms 15.

In order to adjust the acute angle 13 between the two rings 11 and 12, one merely loosens the set screws 18 on clamps 17, thereby permitting arcuate support rods or arms 15 to slide up and downwardly though bottom clamps 17 to properly adjust angle 13. When the desired angle is attained, then set screws 18 are reset to engage support arms 15 and rigidly hold the relative angular position between rings 11 and 12.

Stops 20 in the from of weld spots are provided on the lower end of support arms 15 so that the support arms 15 cannot accidentally completely separate from lower clamps 17 by sliding all the way upwardly therethrough.

It can be readily observed that target auxiliary ring 11 and supporting ring 12 are of the same diameter or size and they are also of the same size and diameter of the standard basketball ring or hoop 21 which supports the entire practice device.

In conventional fashion, standard basketball hoop or ring 21 is secured by bracket 22 to backboard 23.

When utilizing the basketball practice device of the present invention, it can be either mounted directly on top of a conventional or standard basketball hoop 21 as shown, or in fact, the supporting ring 20 can be mounted on a bracket 22 directly to a backboard surface 23. This latter mentioned construction is not specifically shown in the drawings.

In the embodiment of basketball practice device 10 illustrated, supporting ring 12 is supported on standard hoop or ring 21 in a horizontal plane relative to the plane of backboard 23 with a releasable mechanism for secuting the supporting ring 12 to standard ring 21.

This releasable mechanism includes a plurality of circumferentially spaced hooks 24 and 25. These two hooks 24 and hook 25 depend downwardly from supporting ring 12 and engage standard ring or hoop 21 in clamping engagement. Hook 25 is adjustable with an adjustable set screw 26 provided to engage and disengage standard ring 21 thereby permitting separation or relative rotation of supporting ring 12 on top of standard ring 21 about the vertical axis of the two rings.

I claim:

1. A basketball practice device comprising: an auxiliary ring and means supporting said auxiliary ring in general above a basketball supporting ring in a plane disposed at an acute angle from the plane of said supporting ring, and adjustment means for selectively adjusting and maintaining said acute angle.

2. The basketball practice device of claim 1, including backboard support means for supporting said basketball supporting ring in a horizontal plane from a backboard to function as a standard basketball ring.

3. The basketball practice device of claim 2, said backboard support means comprising a standard basketball ring supported from a backboard, said basketball supporting ting is generally similar in size to said standard ring and is adapted to be placed thereon for support therefrom and releasable means for secuting said supporting ring to said standard ring.

4. The basketball practice device of claim 3, said supporting ring adjustably rotatable relative to said standard ring about a vertical axis.

5. The basketball practice device of claim 4, said releasable means including a plurality of circumferentially spaced hooks depending downwardly from said supporting ring and engaging said standard ring in clamping engagement.

6. The basketball practice device of claim 5, wherein one of said hooks is adjustable for permitting separation and relative rotation of said supporting ring relative to said standard ring.

7. The basketball practice device of claim 1, said adjustment means including a hinge secuting said auxiliary ring and supporting ring together for providing selective adjustment of said acute angle on a horizontal axis, at least one support arm disposed between said auxiliary ring and said supporting ring for maintaining a selected angle for said acute angle, and a clamp adapted for adjustably clamping said at least one arm at selectable positions relative to one of said auxiliary ring and said supporting ring for maintaining said rings at the acute angle selected.

8. The basketball practice device of claim 7, including two of said support arms with respective of said clamps, said support arms spaced from each other and said hinge.

9. The basketball practice device of claim 7, including a stop on said at least one arm for preventing said arm from separating from said clamp.

10. The basketball practice device of claim 7, wherein said auxiliary ring is substantially the same size as said standard ring.

* * * * *